US011292695B2

(12) United States Patent
Eisenman et al.

(10) Patent No.: US 11,292,695 B2
(45) Date of Patent: Apr. 5, 2022

(54) STAIR LIFT DEVICE

(71) Applicants: Orna Eisenman, Haifa (IL); David Eisenman, Haifa (IL)

(72) Inventors: Orna Eisenman, Haifa (IL); David Eisenman, Haifa (IL)

(73) Assignee: CLIMBER O.D.E LTD, Haifa (IL)

( * ) Notice: Subject to any disclaimer, the term of this patent is extended or adjusted under 35 U.S.C. 154(b) by 0 days.

(21) Appl. No.: 16/761,255

(22) PCT Filed: Nov. 13, 2017

(86) PCT No.: PCT/IL2017/051230
§ 371 (c)(1),
(2) Date: May 3, 2020

(87) PCT Pub. No.: WO2018/092125
PCT Pub. Date: May 24, 2018

(65) Prior Publication Data

US 2020/0354193 A1 Nov. 12, 2020

(30) Foreign Application Priority Data

Nov. 16, 2016 (IL) ..... 249002

(51) Int. Cl.
*B66B 9/08* (2006.01)
*B66B 7/02* (2006.01)
*A61G 7/10* (2006.01)

(52) U.S. Cl.
CPC ..... *B66B 9/0846* (2013.01); *B66B 7/023* (2013.01); *A61G 7/1001* (2013.01)

(58) Field of Classification Search
CPC ..... B66B 9/0846; B66B 7/023; B66B 9/08; A61G 7/1001
See application file for complete search history.

(56) References Cited

U.S. PATENT DOCUMENTS 2,516,726 A * 7/1950 Saxton ..... B66B 9/083 187/201
2,528,265 A * 10/1950 Cretors ..... B66B 9/083 187/201
2,563,260 A * 8/1951 Miller ..... B66B 9/083 187/201
2,832,436 A * 4/1958 Roberts ..... B66B 9/083 187/201
3,500,963 A * 3/1970 Beutler ..... B66B 9/083 187/289

(Continued)

FOREIGN PATENT DOCUMENTS

CN 204096843 1/2015
GB 2 431 914 5/2007

(Continued)

*Primary Examiner* — Michael A Riegelman
(74) *Attorney, Agent, or Firm* — The Law Office of Joseph L. Felber

(57) ABSTRACT

A stair lift device laid upon a staircase can support upward and downward movement of a platform of the device along stairs of the staircase. The device has two side supports in at least partial contact with the stairs of the staircase for supporting movement of the platform, and each side support can include a rail of the device along which the platform moves.

9 Claims, 7 Drawing Sheets

(56) References Cited

U.S. PATENT DOCUMENTS 3,891,062 A * 6/1975 Geneste ..... B66B 9/16 187/245
4,438,830 A * 3/1984 Born ..... B66B 9/083 187/201
5,050,708 A * 9/1991 Wood ..... B66B 9/0838 187/201
5,105,914 A * 4/1992 Holden ..... B66B 9/0846 187/201
5,193,650 A * 3/1993 Kent, Jr. ..... B66B 9/083 187/201
5,230,405 A * 7/1993 Bartelt ..... B66B 9/0815 187/201
5,319,818 A * 6/1994 Baranowski ..... A61G 3/061 14/71.1
5,476,156 A * 12/1995 Gerber ..... B66B 9/187 187/201
6,105,726 A * 8/2000 Taylor ..... B66B 9/0838 187/201
7,225,899 B2 * 6/2007 Molnar ..... B66B 9/0807 187/201
7,424,932 B1 * 9/2008 Murphy ..... E06C 1/345 182/103
8,002,512 B1 * 8/2011 Blehm ..... B66B 9/193 414/598
8,146,713 B2 4/2012 Rosenthal
2002/0098077 A1 * 7/2002 Beech ..... B66B 9/08 187/201
2007/0161460 A1 * 7/2007 Katz ..... A63G 31/12 482/35
2008/0093176 A1 * 4/2008 Rosenthal ..... B66B 9/083 187/241
2013/0299280 A1 * 11/2013 Friedrich ..... B64D 11/04 187/245
2014/0251733 A1 * 9/2014 Fry ..... B66B 9/0853 187/201
2015/0375965 A1 * 12/2015 Awerbuch ..... B66B 9/0815 187/201
2019/0388286 A1 * 12/2019 Ferlin ..... B66B 9/083

FOREIGN PATENT DOCUMENTS

GB 2529132 2/2016
JP 2001247281 9/2001
JP 2011131990 7/2011
WO 2017024932 2/2017

* cited by examiner

STAIR LIFT DEVICE

TECHNICAL FIELD

Embodiments of the invention relate to a stair lift device, in particular for lifting and lowering people on stairs, e.g. mobility challenged people.

BACKGROUND

People reaching advanced age and/or suffering from disability resulting in reduced mobility, may encounter less ability to get up and down stairs in their home environment. This may result in a necessity to either re-locate to a new home where stairs do not pose a mobility problem or install expensive mobility solutions such as an elevator. Therefore, there is a growing need for solutions to improve the movement for individuals having difficulty in using stairs or the like, which will be relatively in-expensive and simple to install and use.

U.S. Pat. No. 4,627,517 describes a stair lift including a guide track and a toothed wheel driven by a motor for driving a carrying platform that can negotiate bends along a stair case while maintaining a horizontal position of the carrying platform. The guide track is rectangular in cross section to form a shape that is aesthetically justified and gives a good hold for those walking up or down the stairs.

SUMMARY

The following embodiments and aspects thereof are described and illustrated in conjunction with systems, tools and methods which are meant to be exemplary and illustrative, not limiting in scope.

In an embodiment there is provided a stair lift device for being laid upon a staircase to support upward and downward movement of a platform of the device along stairs of the staircase, wherein the device comprising two side supports in at least partial contact with the stairs of the staircase for supporting movement of the platform, where preferably each side support comprises a rail of the device along which the platform moves.

In certain cases, laying the device along the staircase, includes laying portions of the device in contact with the 'zig-zag' and 'step-like' profile of the stairs of the staircase. In certain cases, only portions of the device are in contact with the stairs of the staircase, such as possibly only in contact with intersections of treads and risers of respective steps of the staircase.

In an embodiment, a lower side of the device in contact with the stairs comprises a material 21 for increasing friction with the stairs, preferably an elastic material. (For clarity, the optional friction increasing material 21 is shown only on one step, but it could be applied to all steps.)

In certain cases, the stair lift device is not fixedly attached to the stairs, so that preferably the device can be lifted up and away from the stairs. Such lifting may be performed without need for prior removal of any attachment means fixing the device to the stairs.

In certain cases, where the device may be formed from at least two portions that are foldable one in relation to the other, fixing of only one of the portions may be performed to the stairs, possibly the portion towards which the foldable part is rotated.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
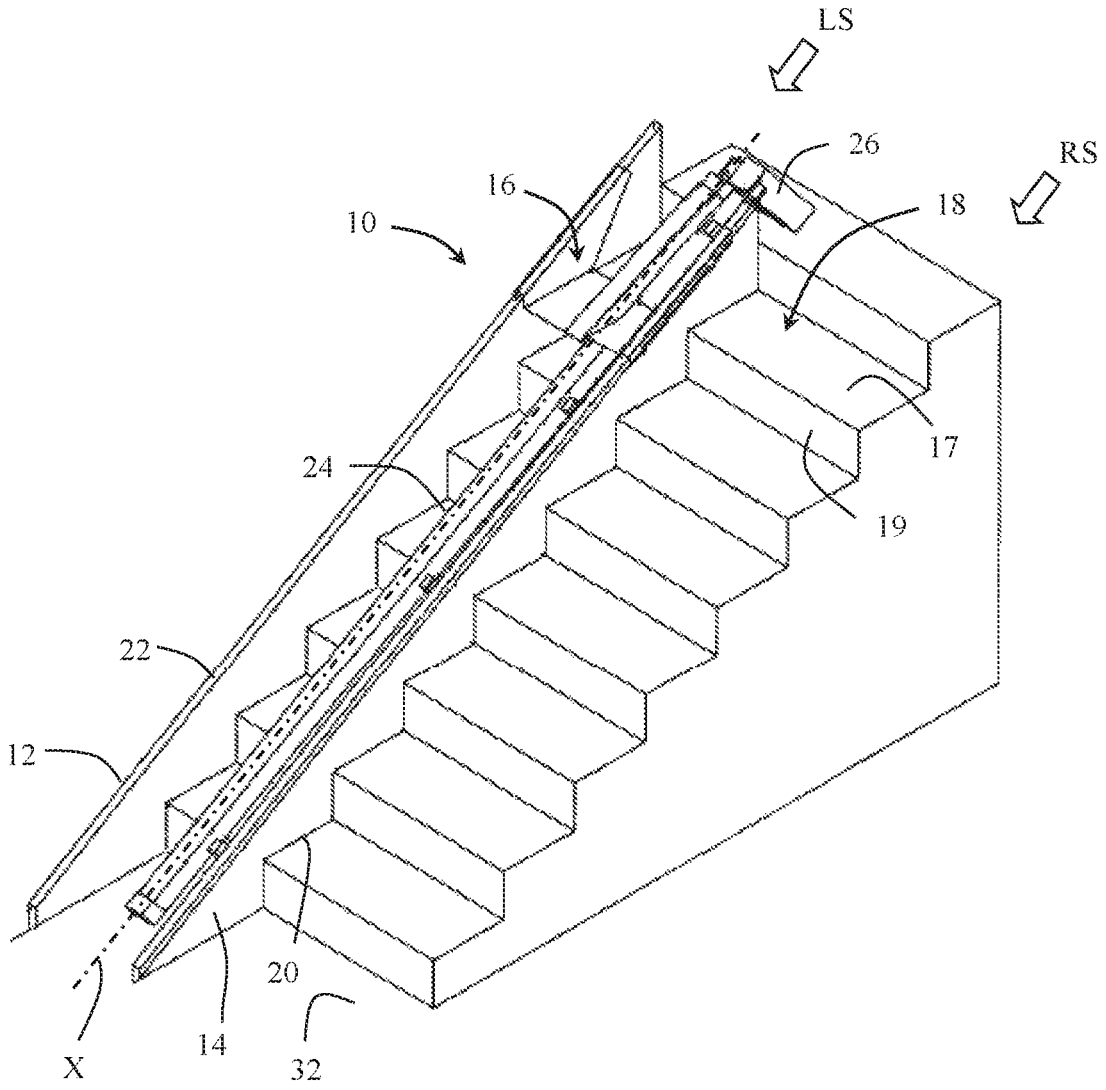
FIG. 1 schematically shows a generally isometric view of a stair lift device in accordance with an embodiment of the present invention mounted on a staircase.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1 schematically illustrating an embodiment of a stair lift device 10 of the invention. Stair lift device 10, here illustrated as being in an optional form of a 'straight run' configuration leading from one floor to another without a turn or change in direction, includes two side supports 12, 14, here in the form of panels, and a platform 16 configured for being moved along an axis X generally parallel to the supports. The supports 12, 14 may be coupled one to the other by lateral extending connectors (see example of a connector 36 in the embodiment of FIG. 3A or 5). The connectors are intended to keep the supports parallel and/or spaced apart one in relation to the other and are configured to extend laterally, in one example, along lower parts of risers 19 of at least some of the stairs in staircase 18.

Stair lift device 10 is configured for being fitted, preferably in a removable manner, to a staircase 18 e.g. in a home environment. In the illustration of FIG. 1, device 10 is fitted to a lateral left hand side LS of staircase 18 leaving a right hand side RS of the staircase free and open for normal assent or descent of the stairs. Platform 16 in this illustration of FIG. 1 is configured for being moved axially up and down by device 10 along the stairs of staircase 18.

Embodiments of stair lift device 10 are configured for ease of assembly so that fitting an embodiment of a stair lift device of the invention to a staircase in e.g. a home environment can easily be performed manually by a person that is not necessarily a specialized technician.

Side supports 12, 14 of device 10 have each in this embodiment a lower edge 20 in this example having a 'zig zag' profile configured to snuggly fit the "step" profile of staircase 18. Edges 20 may be bent to strengthen the structure of supports 12, 14 and may include or be covered by a material, preferably an elastic material, to increase friction between device 10 and staircase 18. The supports 12, 14 in one example may be generally identical and/or may have mirror symmetry one in relation to the other relative to a plane (not shown) that includes axis X and that perpendicularly intersects the steps of staircase 18. Supports 12, 14 may be made from sheets of steel or any other suitable material such as composite or plastic material (or the like).

Embodiments of stair lift devices (see e.g., FIG. 1) including portions with 'zig-zag' profiles that follow and contact a "step" profile of a staircase—have been found to resist axial directed forces that may otherwise act to move the device during use from its intended location. Consequently, this structural relation with the stairs has been found to provide stair lift device embodiments that function properly for lifting or lowering people along staircases without a necessity to fix such devices to the stairs, for example by screws. Thus, an aim of at least one aspect of the invention, of providing a simple to use and assemble stair lift device can be facilitated by such lower edge profiles, or to this extent any other lower portion abutting the stairs, that at least partially follows the contour of the stairs.

In one example, each support 12, 14 may be made from one integral part possibly cut at edge 20 to fit (or at least partially fit) the profile of steps typically included in a staircase such as staircase 18; and possibly an upper edge 22 of each profile may be bent to strengthen the edge 22 and the respective supports 12, 14 and serve as a rail for platform 16.

Platform 16 may be made of steel, plastic material (or the like); and may be movable along the supports 12, 14 e.g. by means of wheels 28 (seen in FIG. 2) and/or ball transfer units, positioned between side portions of the platform and the upper edges 22 of the supports. Platform includes a base 30 (see marked in FIG. 2) that serves as a standing platform for a person using device 10 for getting up and down staircase 18, while said person may stabilize himself (or herself) by means of a hand rail (not shown) either fitted to the platform to be movable therewith or e.g. an existing hand rail of the staircase.

A seating means (not shown) may also be provided for a person ascending a staircase using stair lift device embodiments of the invention. Such seating means may be instead and/or in addition to platform 16, such as located upon a platform generally similar to platform 16.

Some stair lift embodiments may be configured for moving people up or down a staircase, where said people are not necessarily disabled (e.g. may not require a handle bar for holding onto and/or means such as seating means). Such stair lift embodiments may be useful for enabling e.g. people that become older in age, to be able to stay on living in their homes and get around easily by, inter alia, getting more easily up and down stairs in their living environment.

A linear activator 24 (such as those provided under the FESTO ELGA tradename) may be coupled to the stair lift device, e.g. by being coupled to the connectors bridging panels 12, 14; with a sliding element of the activator (not shown) being connected to platform 16 so that it will be movable therewith. Activator 24 can be movable or motorized by a motor 26 while control of motion of the platform such as up or down direction along the stairs, speed, acceleration and deceleration of the activator and consequently platform 16 may be controllable by a user of device 10 or may be pre-defined prior to use. Motor 26 may receive power form an electric grid e.g. of the household and/or from a battery—so that embodiments of stair lift devices including batteries can function also when electrical power from the grid is absent.

In one embodiment, stair lift device 10 may be simply laid upon the stairs of staircase 18 while not necessarily being fixed to the stairs e.g. by screws. Such configuration may permit an embodiment of a stair lift device 10, such as that here seen, that has been fitted to extend along a lateral left hand side LS of staircase 18 to be manually re-positioned if required e.g. to extend along a lateral right hand side RS of the stairs. In addition, such 'non-fixed' configuration may permit also lifting and putting aside of the device 10 to free the stairs if use of device 10 is periodically not required.

Figure 2:
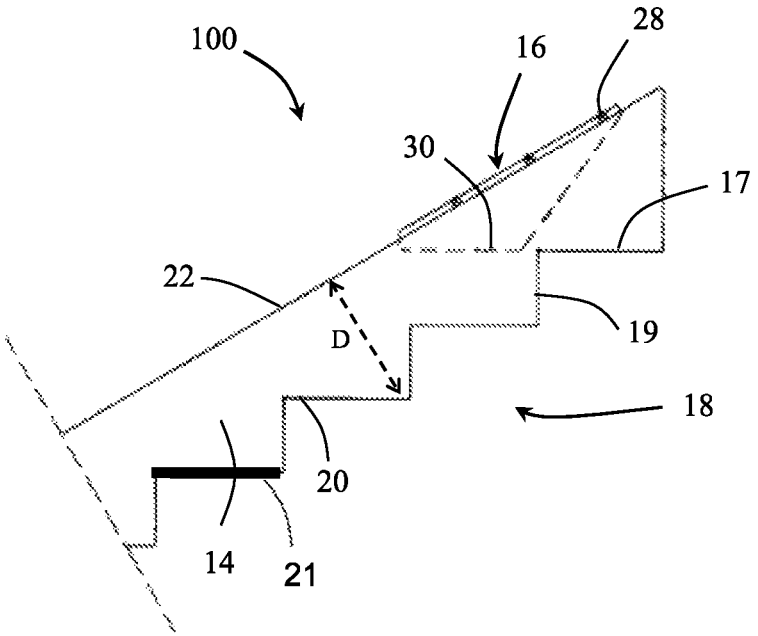
FIG. 2 schematically shows a side view of an embodiment of a stair lift device, generally similar in at least certain aspects to that in FIG. 1.

Attention is drawn to FIG. 2 illustrating a partial side view of an embodiment of a stair lift device 100 generally similar to device 10 illustrated in FIG. 1. In device 100, as in device 10, a base 30 of the platform 16 upon which a user of the device is adapted to stand or be seated, is configured to be generally parallel to respective planes of the treads 17 of each stair in the staircase. In addition, base 30 is configured to reach positions along staircase 18 where it is co-planar with the treads 17 of each stair in staircase 18. In the shown example of FIG. 2, platform 16 is positioned at an uppermost location along staircase 18 with base 30 being co-planar and adjacent the tread 17 of the uppermost stair of the staircase—to permit easy and comfortable descent or ascent of a user from the device 100 at the top of the staircase.

Possibly, an embodiment of a stair lift device of the invention is configured to have an upper limit where base 30 is co-planar with a tread of an uppermost stair in the staircase, and a lower limit where base 30 rests parallel upon a plane 32 (see FIG. 1) from which the staircase 18 ascends.

Figure 3A:
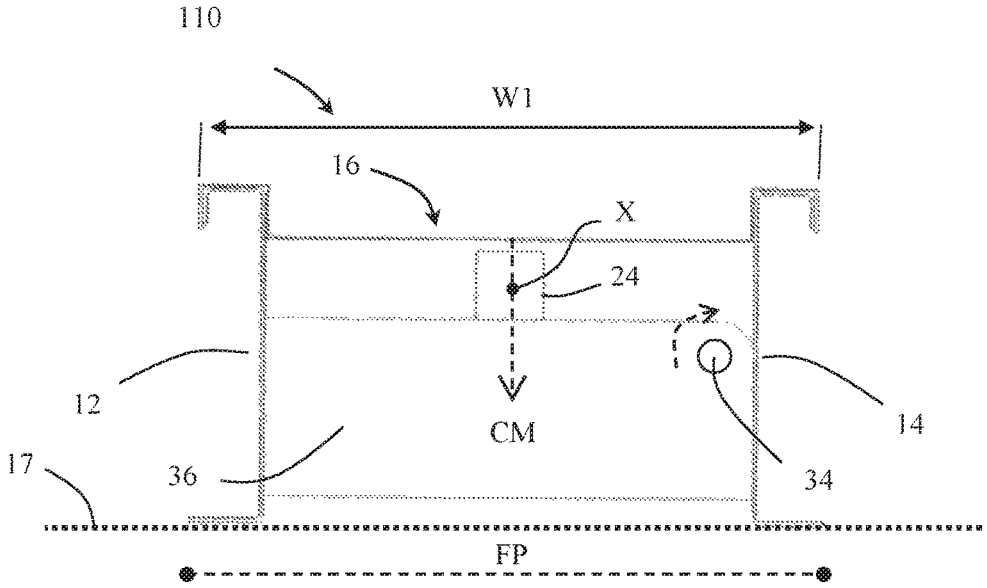
FIGS. 3A and 3B schematically show cross sectional views of an embodiment of a stair lift device, generally similar in at least certain aspects to those in FIGS. 1 and 2.
Figure 3B:
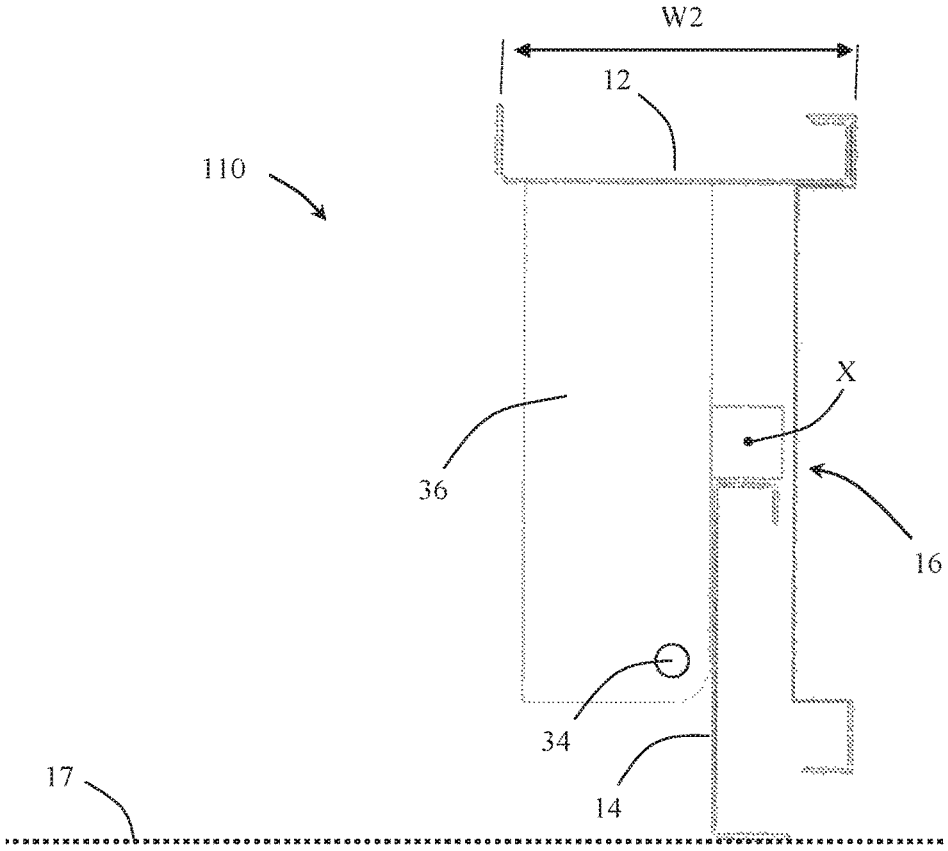

Attention is drawn to FIGS. 3A and 3B illustrating cross sectional views of a possible embodiment of a stair lift device 110 of the invention, possibly generally similar to devices 10 and 100 shown in the previous figures. The cross sectional views of these figures are taken in a plane generally perpendicular to axis X along which a platform 16 of the device is configured to move; and at a location where the device overlies a tread 17 of a stair in a staircase such as staircase 18 seen in FIGS. 1 and 2.

Stair lift device 110 in this example includes two side supports 12, 14 here seen at a location where they are positioned on a tread 17 of a stair and adjacent a riser of a step in staircase 18. In addition, device 110 includes connectors 36 bridging the two side supports 12 and 14 that are intended to keep the supports, here in optional panel-like formations, parallel and/or spaced apart one in relation to the other in an operative state of the device where it is configured to lift or lower people along a staircase. Each connector in this example is fixed to one of the supports, here left support 12—while in this possible example being hinged at a hinge 34 to the other support, here right support 14.

FIG. 3A represents a cross sectional view of device 110 in an operative state suitable for lifting people up or down a staircase, and FIG. 3B represents a cross sectional view of device 110 in a folded non-operative state. In the operative state (FIG. 3A) device 110 has a lateral width W1 along the staircase and in the non-operative state (FIG. 3B) device 110 has a lateral width W2 along the staircase that is substantially smaller than W1, for example about 50-60% of W1 or less.

Lateral width W2 in the shown example may be equal to a maximal distance (see marked as 'D' in FIG. 2) that a side support, here support 14, spans above the profile of the staircase it ascends. In other words, distance 'D' (or W2) in this example may be measured along an imaginary line (here marked as a dashed line) that is perpendicular to the upper edge 22 of the side support and intersects the lower edge 20 of the side support adjacent a location where edge 20 is configured to meet a lower end of a riser 19 of a step in the staircase (e.g. at an intersection of a tread and a riser that extends above the tread).

Altering this embodiment of stair lift device 110 from the operative state seen in FIG. 3A to the non-operative state seen in FIG. 3B (that device 110 may assume when folded and not in use)—may be activated by manually lifting side support 12 upwards to pivot it about hinge 34.

In certain embodiments, one of the side supports may be fixed to the staircase while the other side support is not fixed to the staircase. In the embodiment of FIG. 3, the side support fixed to the staircase may be support 14 and the support not fixed to the staircase may be support 12 that is configured to be lifted up to rotate about hinge 34 when altering the state of device 110 towards its folded state.

Attention is drawn to FIG. 3A, to discuss an aspect of at least certain embodiments of the invention that may be common to both foldable, non-foldable or any other envisioned embodiment's. Thus, the cross section of FIG. 3A may be considered representative of a cross section of e.g. the embodiment shown in FIG. 1—where hinge 34 is not present and e.g. connector 36 is fixedly attached to side support 14. In an aspect of the invention, a center of mass CM of at least certain embodiments of the stair lift device (with or without a person mounted upon it) may be configured not to go beyond a foot-print of the device—so as not to form moment forces that may otherwise act to turn over the device, in particular when a person stands on the device. Therefore, stair lift devices of at least certain embodiments of the invention also possibly not fixedly attached to the staircase may safely transfer people up or down the staircase.

Such non-permanent fixing of at least certain stair lift device embodiments to a staircase, possibly enabling lifting and/or removing of the device from the staircase, may be performed without leaving any remaining marks on the staircase. For example, in certain cases at least certain stair lift devices may be laid unattached on the staircase during operative use of the device for lifting or lowering people along the staircase without any means being used for attaching such devices to the staircase, such as bolts, adhesive (or the like) that may leave marks on the staircase after removal.

Figure 4A:
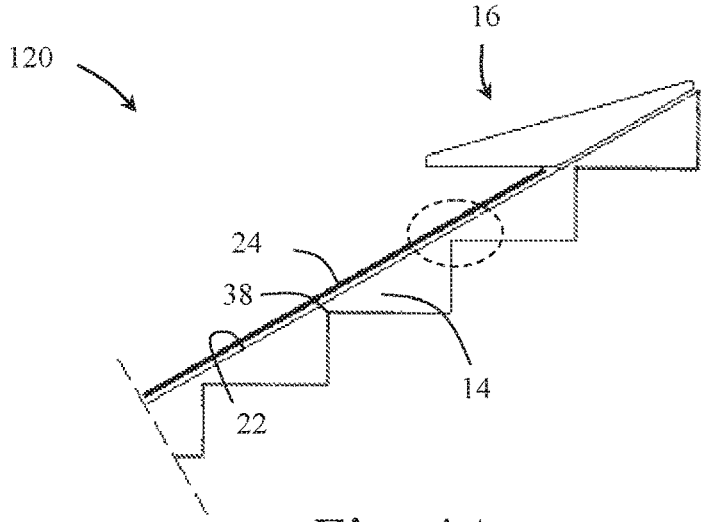
FIGS. 4A to 4C schematically show views of an embodiment of a stair lift device, generally similar in at least certain aspects to those in FIGS. 1 to 3.
Figure 4B:
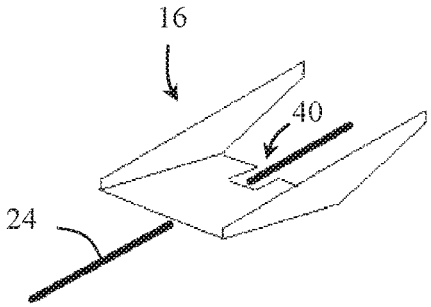

Attention is drawn to FIGS. 4A and 4B illustrating a possible embodiment of a stair lift device 120 of the invention. In the schematic of FIG. 4A, device 120 is shown from a side view revealing one of its side supports, here support 14, however another generally parallel running side support 12 is present as in the embodiments of e.g. FIGS. 1 to 3. In device 120 an upper edge 22 serving as a rail for platform 16 extends alongside and adjacently above intersections 38 where treads and riser of each respective step in the staircase meet—consequently forming a compact low profile for device 120 above the staircase. In such configuration, activator 24 may extend in a side view above upper edge 22 and may pass within a notch 40 formed in platform 16.

Such "low" side profile of the side supports as in device 120 may be also advantageous in embodiments of a stair lift device that are configured to be foldable, such as in FIG. 3—since, e.g., a corresponding distance D (see marked in FIG. 2) of such a device is configured to be small resulting in a short width W2 that such a device may have when folded.

The side supports of the embodiments of the present invention may be formed as panels filling substantially most the area between edge 22 and the profile of the steps (as in FIG. 1 where they extend between edges 22, 20). However in some cases, the side supports may not necessarily fill all this area. For example, in the embodiment shown in FIG. 4C the side supports may have a bar-like formation extending along the intersections 38 of the staircase essentially acting as rails along the staircase for a movable platform.

Figure 4C:
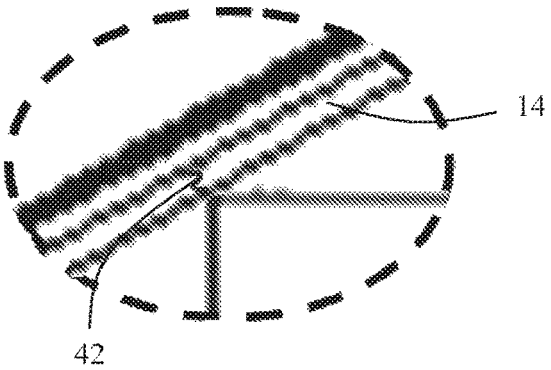

In some cases, the side supports may also be divided into segments that connect at merges 42 as illustrated in FIG. 4C. Here the bar-like formation of the side support is illustrated being formed from segments however also "panel" shaped side supports (or any other suitable formation of the side supports) may be configured to be formed from segments. Division of the side supports into segments may in some cases assist is modular formation and assembly of certain stair lift device embodiments.

Figure 5A:
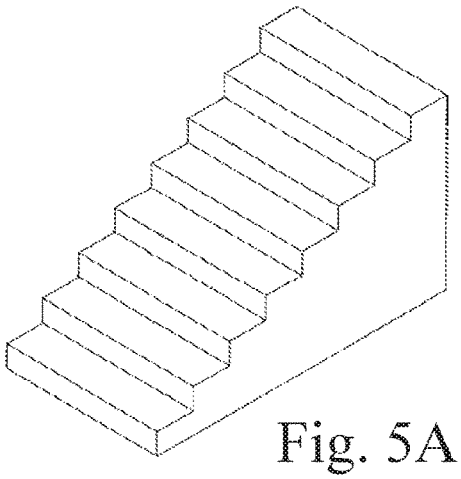
FIGS. 5A to 5E schematically show generally isometric views of an embodiment of a stair lift device, generally similar in at least certain aspects to those in FIGS. 1 to 4.
Figure 5B:
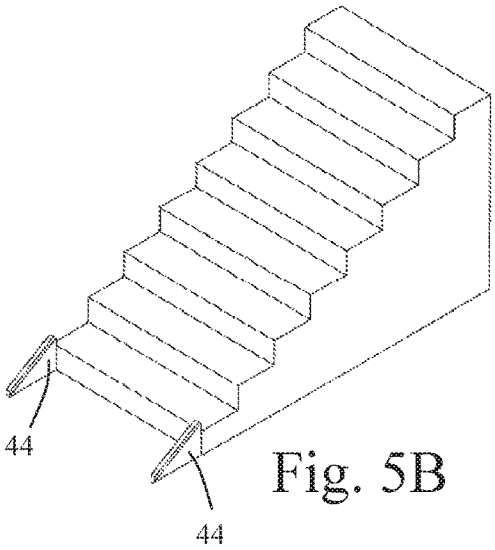
Figure 5C:
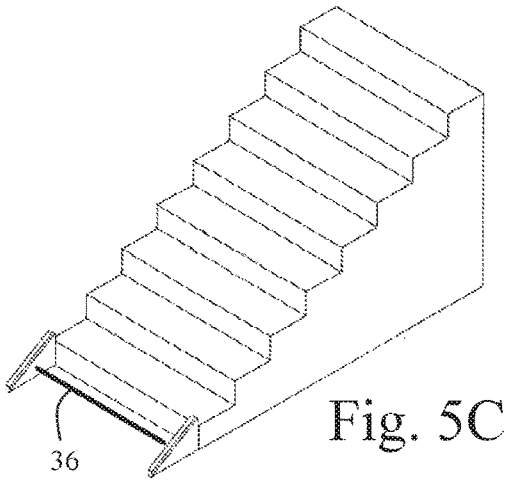

Attention is drawn to FIGS. 5A to 5E illustrating one possible "modular" embodiment of a stair lift device 130. In FIG. 5A a staircase is illustrated and in FIG. 5B two left and right segments 44 of a side support of device 130 are shown placed here at a lower end of the staircase. In FIG. 5C one possible subsequent step of assembly of device 130 is illustrated being placement of a connector 36 that is attached to the segments 44 and that is configured to keep the segments generally parallel one to the other and/or spaced apart.

Figure 5D:
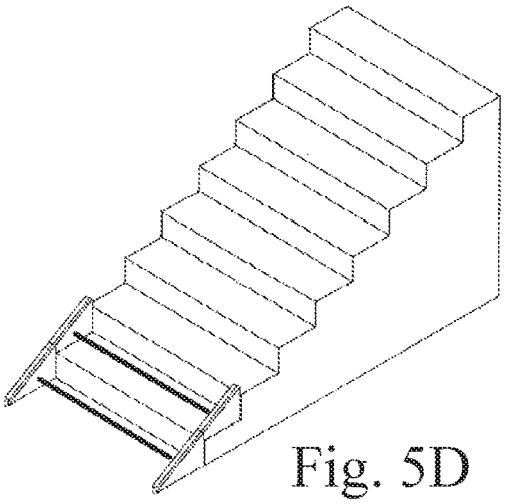
Figure 5E:
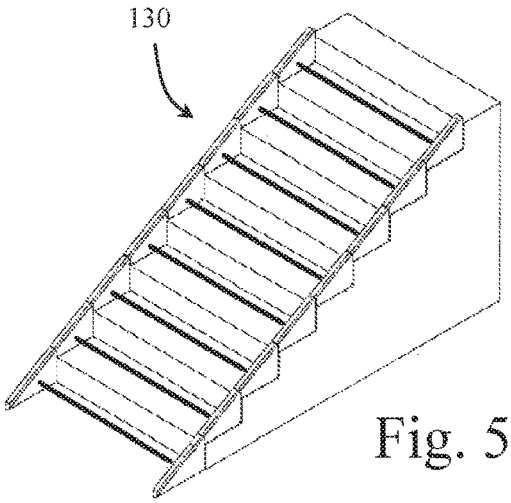

In FIG. 5D two additional segments of the side support are assembled on a stair above with a connector that is attached to them, and assembly of the "modular" stair lift device may be continued in this general manner until the side supports of the device extend along the full span of the staircase or any other required portion of the staircase. Once the side supports have been assembled, additional elements of the device can be added, such as the linear activator, platform and the like. Although here the full lateral extension of the stairs are illustrated being occupied by device 130, only a part of the lateral extension of the staircase, such as in the embodiment of FIG. 1, may be occupied by a stair lift device such as device 130.

Figure 6A:
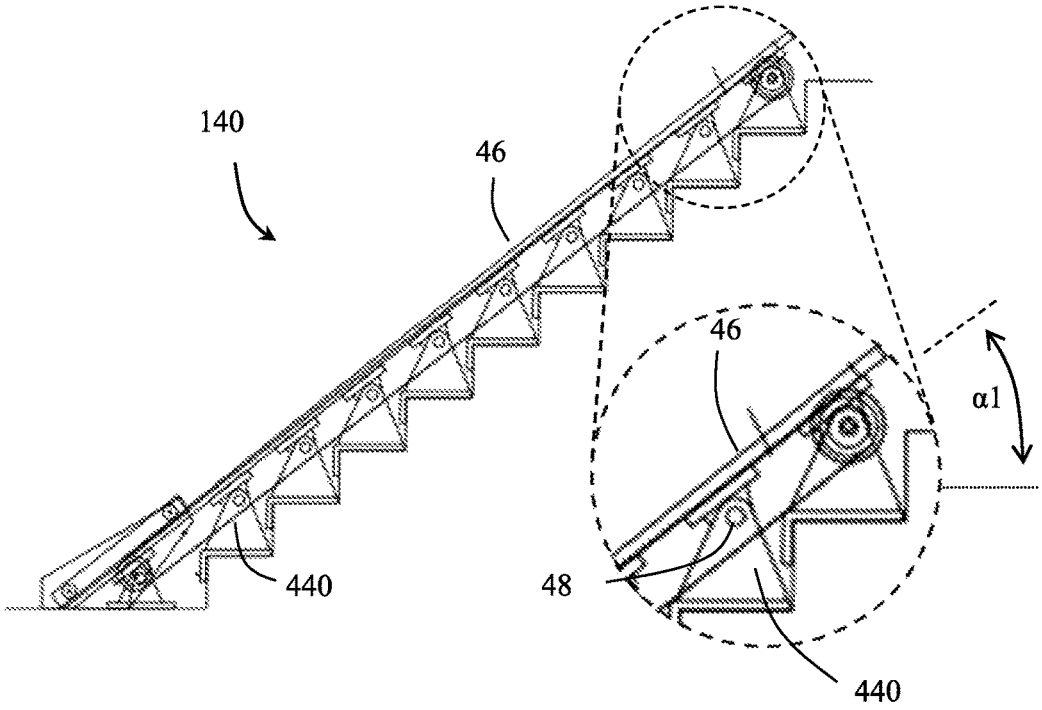
FIGS. 6A and 6B schematically show side views of an embodiment of a stair lift device, generally similar in at least certain aspects to those in FIGS. 1 to 5.
Figure 6B:
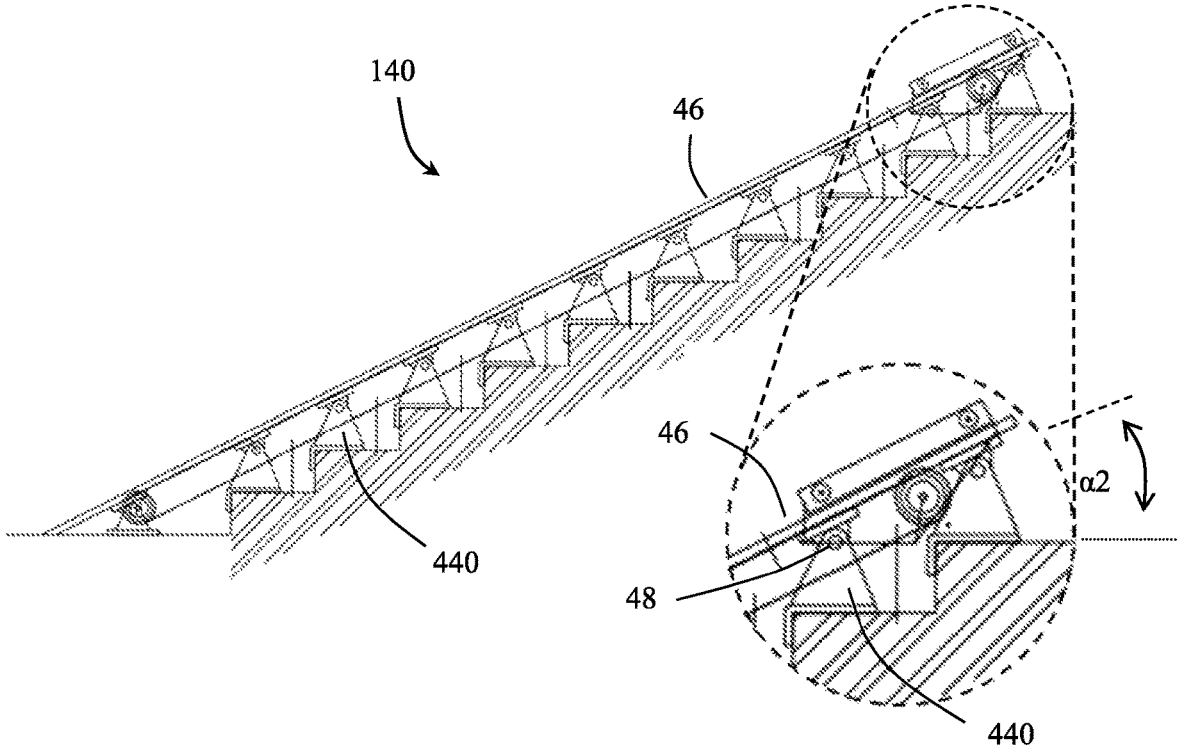

Attention is drawn to FIGS. 6A and 6B illustrating a right-hand side view of one other possible "modular" embodiment of a stair lift device 140. Stair lift device 140 also includes two left and right segments 440 of a side support of the device located on each stair of the staircase, with here only the right segments being visible. Right and left rails 46 (only right rail being visible) may be fixed, respectively, to upper sides of the right and left segments 440.

In an embodiment of the invention, fixing of the rails to the segments 440 may be via pivots 48 in order to, inter alia, facilitate adjustment of stair lift device 140 to staircases of varying steepness. In the example illustrated in FIG. 6A, the stair lift device is illustrated being mounted to a staircase having a steepness angle of al and in FIG. 6B, the stair lift device is illustrated being mounted to a staircase having a steepness angle of $\alpha 2$ that is different, here smaller, that angle $\alpha 1$.

Figure 7A:
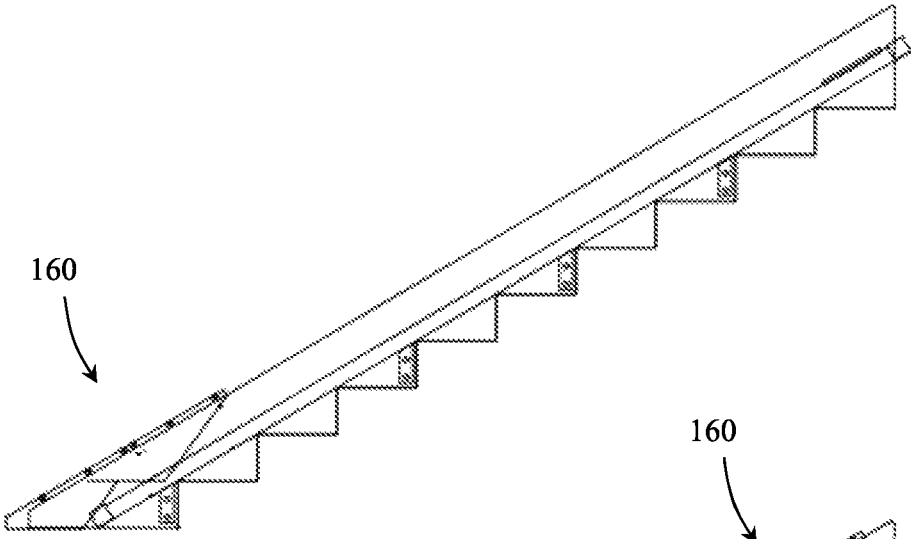
FIGS. 7A and 7B schematically show side views of another embodiment of a stair lift device.
Figure 7B:
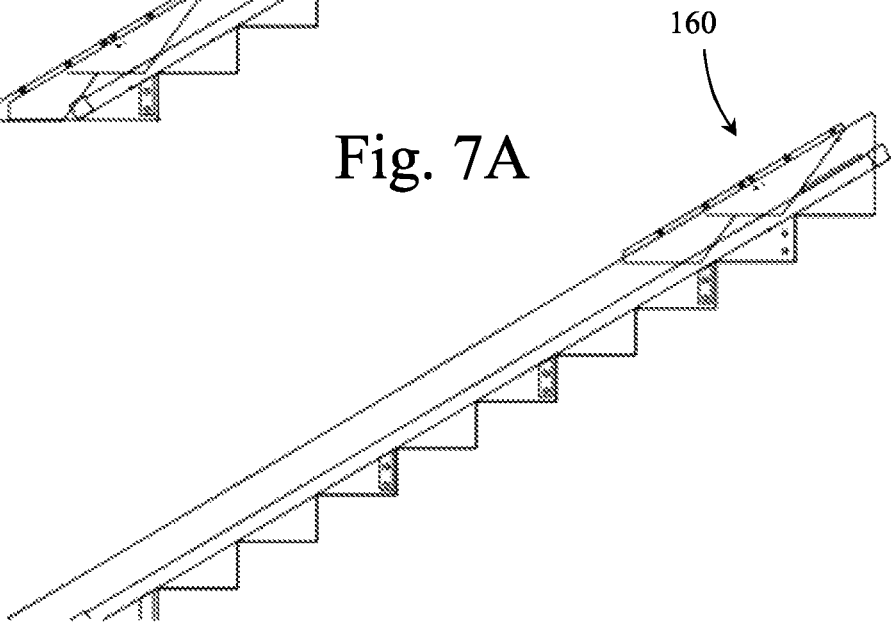

Attention is drawn to FIGS. 7A and 7B illustrating a stair lift embodiment of the invention having a two-stepped platform 160. Platform 160 may include such two steps in two different levels corresponding to treads of adjacent stairs in the staircase. Such two-stepped platform may permit urging two people up or down the staircase, possible one standing behind the other. In FIG. 7A platform 160 is seen at a lower side of the staircase and in FIG. 7B platform 160 is seen at an upper part of the staircase.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Further more, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures can not be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A stair lift device for being laid upon a staircase to support upward and downward movement of a platform of the device in an axial direction along stairs of the staircase, wherein the device comprising two lateral side supports in at least partial contact with the stairs of the staircase for supporting movement of the platform, where each side support comprises a rail of the device along which the platform moves, wherein at all positions of the platform along the stairs of the staircase the stair lift device also when supporting a person mounted thereupon comprises a center of mass that is located between lateral side supports of the device so as to not extend axially and laterally beyond a foot print and/or a boundary of the lateral side supports when viewed from above, and wherein the stair lift device is not fixedly attached to the stairs, so that the device can be lifted up and away and/or removed from the stairs, wherein the platform at a lowermost position along the stairs of the staircase rests parallel upon a plane from which the staircase ascends and generally flush with the plane, and wherein a lower side of the device in contact with the stairs comprises a zig-zag like contour fitting closely the step shape of the stairs to permit contact between the device and the stairs at least along most of the contour, the stair lift device further being formed from at least two portions that are foldable one in relation to the other, wherein each one of the portions comprises a rail of the device, and the stair lift device further comprising at least one connector for connecting between the two side supports and the connector is fixed at one side to one of the side supports and is hinged at the other side to the other side support, and the at least two portions that are foldable one in relation to the other are foldable about the hinge.

2. The stair lift device of claim 1, wherein a lower side of the device in contact with the stairs comprises a material for increasing friction with the stairs.

3. The stair lift device of claim 2 and comprising connectors for connecting the side supports one to the other.

4. The stair lift device of claim 1, wherein a base of the platform configured for supporting a person up or down the stairs is generally parallel to treads of the stairs in the staircase.

5. The stair lift device of claim 4, wherein the base in an uppermost position of the platform along the stairs is configured to comprise a portion that is co-planar with a tread of an uppermost stair in the staircase.

6. The stair lift device of claim 1, wherein the side supports are divided into separate segments.

7. A stair lift device for being laid upon a staircase to support upward and downward movement of a platform of the device in an axial direction along stairs of the staircase, wherein the device comprising portions of lateral side supports in at least partial contact with the stairs of the staircase for supporting movement of the platform, and wherein at all positions of the platform along the stairs of the staircase the stair lift device comprises a center of mass that is located between the lateral side supports of the device so as to not extend axially and laterally beyond a foot print and a boundary of the lateral side supports when viewed from above, and the platform at a lowermost position along the stairs of the staircase rests parallel upon a plane from which the staircase ascends and generally flush with the plane, and wherein a lower side of the device in contact with the stairs comprises a zig-zag like contour fitting closely the step shape of the stairs to permit contact between the device and the stairs at least along most of the contour, the stair lift device further being formed from at least two portions that are foldable one in relation to the other, wherein each one of the portions comprises a rail of the device, and and the stair lift device further comprising at least one connector for connecting between the two side supports and the connector is fixed at one side to one of the side supports and is hinged at the other side to the other side support, and the at least two portions that are foldable one in relation to the other are foldable about the hinge.

8. The stair lift device of claim 7 wherein the center of mass of the device also when supporting a person mounted thereupon similarly does not extend beyond a foot print of the device when viewed from above.

9. The stair lift device of claim 7 and not being fixedly attached to the stairs, so that preferably the device can be easily lifted up and away and/or removed from the stairs, further preferably without leaving any marks on the staircase.

* * * * *